United States Patent [19]

Dodwell

[11] 4,287,298

[45] Sep. 1, 1981

[54] FILM BASE MATERIAL CONTAINING A COMBINATION OF SURFACTANTS

[75] Inventor: Geoffrey M. Dodwell, Brentwood, England

[73] Assignee: Ciba-Geigy AG, Basel, Switzerland

[21] Appl. No.: 119,067

[22] Filed: Feb. 6, 1980

Related U.S. Application Data

[60] Division of Ser. No. 935,397, Aug. 21, 1978, Pat. No. 4,244,988, which is a continuation of Ser. No. 777,285, Mar. 11, 1977, abandoned.

[30] Foreign Application Priority Data

Apr. 14, 1976 [GB] United Kingdom ..... 15165/76

[51] Int. Cl.[3] ..... G03C 1/78

[52] U.S. Cl. ..... 430/533; 427/171; 427/173; 430/529; 430/535

[58] Field of Search ..... 96/87 R, 87 A; 427/171, 427/173; 430/271, 535, 529, 533

[56] References Cited

U.S. PATENT DOCUMENTS

| | | | |
|---|---|---|---|
| 2,943,937 | 7/1960 | Nadeau | 96/87 R |
| 3,370,951 | 2/1968 | Hasenauer et al. | 96/87 R |
| 3,443,950 | 5/1969 | Rawlins | 96/87 R |
| 3,589,905 | 6/1971 | Reedy et al. | 96/87 R |
| 3,674,531 | 7/1972 | Shephard et al. | 96/87 R |
| 3,919,156 | 11/1975 | Khanna et al. | 96/87 R |

OTHER PUBLICATIONS

Schonfeldt "Surface Active Ethylene Oxide Adducts", 1969, pp. 560–561, Pergnon Press, Ltd. Oxford.

*Primary Examiner*—Jack P. Brammer

*Attorney, Agent, or Firm*—Sprung, Felfe, Horn, Lynch & Kramer

[57] ABSTRACT

Film base material is provided which comprises a film of biaxially oriented synthetic linear polyester of highly hydrophobic character having superimposed thereon adherent to said film a subbing layer obtained from an aqueous latex of a copolymer which has been prepared by copolymerizing vinylidene chloride, an alkyl acrylate or methacrylate and optionally a copolymerizable acid and/or at least one allyl, methallyl or vinyl monomer which contains either an active halogen group or an active methylene group in the presence of a mixture of (a) an anionic surfactant which is either an alkyl aryl polyether sulphate, sulphonate or phosphate and (b) a nonionic surfactant which is an alkyl aryl polyalkylene oxide adduct containing at least some units derived from propylene oxide.

The subbing layer improves the adhesion between the film support and the photographic emulsion layers and prevents the separation or frilling of the layers when the final photographic film is processed. Further the surface conductivity of the film base is improved so that there is no need for a separate antistatic layer.

8 Claims, No Drawings

FILM BASE MATERIAL CONTAINING A COMBINATION OF SURFACTANTS

This is a division of application Ser. No. 935,397, filed Aug. 21, 1978, now U.S. Pat. No. 4,244,988, which is a continuation of Ser. No. 777,285, filed Mar. 11, 1977, now abandoned.

This invention relates to synthetic film materials, and more particularly to film base materials of use in the production of photographic materials.

It is known that self-supporting films formed of synthetic linear polyesters, particularly of the polyesters formed by reaction of ethylene glycol and terephthalic acid, may be prepared with mechanical and physical and chemical properties which, for example, render them very suitable indeed as base materials on which may be coated silver halide emulsion layers for the production of photographic film materials.

However, since such base materials are inherently highly hydrophobic and the usual gelatino silver halide emulsions are highly hydrophilic, there is great difficulty in securing adequate anchorage between the base film and the emulsion layer, especially bearing in mind that the anchorage must remain firm throughout the processing sequence of the final photographic film.

It is known to deal with such a difficulty by the provision of an anchoring layer or layers (so-called "subbing" layers) between the film base and the emulsion layer, but the materials hitherto suggested for this purpose in connection with other film bases have not always proved entirely satisfactory when applied to film base of synthetic linear polyesters of highly hydrophobic character.

Therefore according to the present invention there is provided a method of preparing film base material consisting of biaxially oriented synthetic linear polyester of highly hydrophobic character which comprises coating as a layer on to a layer-receptive film of linear polyester an aqueous latex of a copolymer which has been prepared by copolymerising vinylidene chloride, an alkyl acrylate or methacrylate and optionally a copolymerisable acid and/or at least one allyl, methallyl or vinyl monomer which comprises either an active halogen group or an active methylene group in the presence of a mixture of an anionic surfactant which is either an alkyl aryl polyether sulphate or sulphonate of the formula

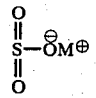

or an alkyl aryl polyether phosphate of the formula

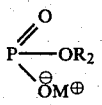

wherein R is alkyl of 6 to 10 carbon atoms, $R_1$ is hydrogen or alkyl of 1 to 5 carbon atoms, N is hydrogen, an alkali metal or ammonium, $R_2$ is hydrogen, an alkali metal, ammonium or alkyl of 1 to 5 carbon atoms, m is 0 or 1 and n is 3 to 15, and a nonionic surfactant which is an alkyl aryl polyalkylene oxide containing at least some hydroxypropylene oxide derived units of the formula

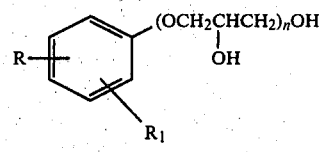

(3)

or of the formula

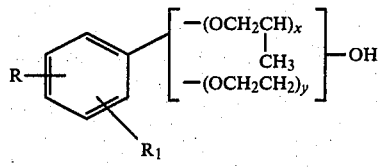

(4)

where R, $R_1$ and n have the meanings assigned to them above, x is 1 to 4 and y is 3 to 10, the proportions of nonionic to anionic surfactant being from 1 to 50 by weight of to 50 to 50 by weight, the total amount of surfactant present in the aqueous medium being up to 3% W/V of the monomers used, and then drying the coated layer and completing the orientation if it has not already been fully biaxially oriented.

The preferred anionic surfactants for use in the present invention are the alkyl aryl sulphates of formula (1) wherein m is 1.

Preferably $R_1$ is hydrogen, M is an alkali metal and n is 8 to 10.

The preferred nonionic surfactants for use in the present invention are the alkyl aryl polypropylene oxides of formula (3).

Preferably $R_1$ is an alkyl group of 1 to 5 carbon atoms and n is 6 to 10.

In the surfactant of formula (4) because of the method of preparation the distribution of propylene oxide and ethylene oxide units in the chain of the surface active agent of formula (4) may be of random nature. Also the ratio of propylene oxide units to ethylene oxide units can only be represented statistically.

The surface active agents of formula (4) are known compounds and are marketed by A.B.M. Chemicals Limited. The surface active agents of use in the present invention may be prepared in the manner conventionally used for the preparation of polyethylene oxide-containing surface active agents by the sequential or simultaneous addition of propylene oxide and ethylene oxide at room temperature to the hydrophobe base in the presence of an alkaline catalyst such as caustic soda.

The preferred surfactants of formula (4) for use in the present invention are those wherein y is 2x.

The preferred ratio of nonionic surfactant to anionic surfactant is from about 3 to 50 to about 20 to 50 parts by weight.

By "layer-receptive film of linear polyester" is meant either a film of linear polyester which is in a state in which it is receptive to a coating of an aqueous latex or which has been pretreated to render it receptive to a coating of an aqueous latex.

A polyester film which has been biaxially oriented is highly hydrophobic but a film of polyester which has not been oriented at all or which has been oriented in one direction only is receptive to a subbing coating. If such a subbing coating is applied to a polyester film which has been oriented in one direction only and is dried, the polyester film can then be oriented in the second direction and the applied coating as long as it comprises polymeric material which is above its second order transition temperature during the stretching will remain firmly anchored on the polyester film. This coating will then form a layer on to which more hydrophilic coatings can be applied. It is possible to coat polyester film which has not been oriented at all with a hydrophilic layer and then to stretch it in two directions with the coating on it but this is not advantageous as the coating requires to be thicker which can lead to a poorer coating quality.

Alternatively polyester film material and in particular biaxially oriented polyester film material may be treated so as to render its surface receptive to an applied coating.

Preferably the treatment of the surface of the film of synthetic linear polyester which enables a polymer layer to adhere thereto is to coat on to the surface of the polyester film an organic solvent solution or aqueous solution of a phenolic adhesion promoting agent and then to remove the solvent, preferably by evaporation.

Synthetic organic solvents in which to dissolve the phenolic adhesion promoting agents are methanol, ethanol, methyl ethyl ketone, acetone and dioxan and mixtures thereof.

By "phenolic adhesion promoting agent" is meant a phenol-based or naphthol-based compound which is capable of acting on the polyester film base so as to render the surface more receptive to an applied layer. Examples of such compounds are m-cresol, o-cresol, resorcinol, orcinol, catechol, pyrogallol, 1-naphthol each of which compounds may be substituted with one or more chloro-, fluoro- or nitro substituents and phenol substituted with one or more chloro-, fluoro- or nitro-substituents. The action of the adhesion promoting agent on the polyester film base is thought to be swelling action and polyester surfaces so treated are receptive to certain polymeric subbing layers but not to hydrophilic layers for example a gelatin or polyvinyl alcohol.

Alternatively the film of polyester may be treated by a physical method, for example corona discharge treatment, which renders the surface capable of accepting a resin layer as described in British patent specifications Nos. 1,262,127, 1,267,215 and 1,286,457.

Preferably the copolymer formed in the process of the present invention comprises from 60 to 90 mole % vinylidene chloride, from 7 to 20 mole % alkyl acrylate or methacrylate, from 0 to 3 mole % copolymerisable acid and from 5 to 20 mole % of the allyl or vinyl component.

In the copolymer of use in the present invention the vinylidene chloride units give the copolymer good film-forming properties and good adhesion to the polyester. The presence of the allyl or vinyl component which contains at least one active halogen atom or methylene group in the copolymer enables a hydrophilic layer for example a gelatin or a polyvinyl alcohol based layer which has been coated on the film base material of the present invention to adhere very strongly to the film base material.

The presence of the copolymerisable acid component in the copolymer helps the overall dry adhesion properties of the copolymer subbing layer. The preferred copolymerisable acid is itaconic acid.

Other acids which may be present are units derived from acrylic acid, methacrylic acid, maleic acid, fumaric acid, crotonic acid, mesaconic acid and citraconic acid.

The alkyl acrylate or methacrylate are required to be present to control and modify the film-forming properties of the copolymer.

Examples of suitable allyl, methallyl or vinyl monomers having an active halogen group which may be incorporated into the copolymer of use in the present invention are compounds of the formula

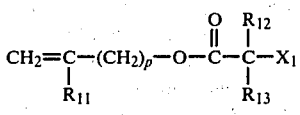

(5)

wherein p is 0 or 1, $R_{11}$ is hydrogen or methyl when p is 1 but is hydrogen when p is 0, $X_1$ is bromine or chlorine and $R_{12}$ and $R_{13}$ are each hydrogen or methyl or are the same halogen atom as $X_1$, or compounds of the formula

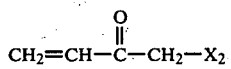

(6)

wherein $X_2$ is chlorine or bromine.

Formula (5) covers two classes of monomers: allyl or methallyl halogeno esters of the formula

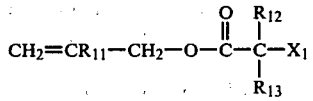

(7)

and vinyl halogeno esters of the formula

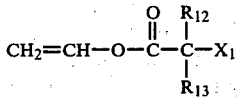

(8)

wherein $R_{11}$, $R_{12}$, $R_{13}$ and $X_1$ have the meanings given to them above.

The preferred monomers of formula (7) for use in the copolymer of use in the present invention are those wherein $R_{11}$ is hydrogen and $X_1$ is chlorine. The most preferred monomer is allyl monochloroacetate.

The preferred monomers of formula (8) for use in the copolymer of use in the present invention are those wherein $X_1$ is chlorine and the most preferred monomer is vinyl monochloroacetate which is available commercially.

The allyl or methallyl halogeno esters of formula (7) may be prepared by reacting allyl or methallyl alcohol with the appropriate halocarboxylic acid.

The vinyl halogenesters of general formula (8) may be prepared by reacting acetylene with the appropriate halocarboxylic acid in the presence of a catalyst, for example mercuric oxide or by the transvinylation reaction between vinyl acetate and the appropriate halocarboxylic acid.

The halomethyl vinyl ketones of formula (6) may be prepared by the method of Cath et al, J. Chem. Soc. 1948, page 278.

Examples of suitable vinyl monomers having a methylene group, which may be incorporated into the copolymer of use in the present invention are cyanomethyl or acetoxymethyl vinyl ketones of the formula $$CH_2{=}CH{-}\overset{\overset{\displaystyle O}{\|}}{C}{-}CH_2{-}Q \qquad (9)$$

wherein Q is CN or $$O{-}\overset{\overset{\displaystyle O}{\|}}{C}{-}CH_3,$$

or a vinyl acetate of the formula $$CH_2{=}CH{-}O{-}\overset{\overset{\displaystyle O}{\|}}{C}{-}CH_2{-}Z \qquad (10)$$

wherein Z is —CN, —$COCH_3$ or —CO—$C_6H_5$ where the phenyl group maybe further substituted by for example halogen, nitro, lower alkyl, or lower alkoxy groups each of 1 to 4 carbon atoms.

The acctoxymethyl vinyl ketone may be prepared from chloromethyl vinyl ketone (prepared by method of Cath et al, J. Chem. Soc. 1948, page 278) by the method described by A. Arbuzow and A. M. Korolev, Zhurnal Obshchei Khimii. Vol. 32, No. 11, pp 3674–3676, November 1967.

The cyanomethyl vinyl ketone may be prepared by the reaction of potassium cyanide and chloromethyl vinyl ketone.

The vinyl cyanoacetate and benzoyl and ring substituted benzoyl acetate may be prepared by the transvinylation reaction as described in U.S. Pat. No. 3,093,161.

The vinyl acetoacetate may be prepared by the pyrolysis of ethylene glycol esters as described in German OLS No. 2,142,419.

Examples of suitable allyl or methallyl monomers having an active methylene group which may be incorporated into the copolymer of use in the present invention are compounds of the formula $$CH_2{=}\underset{\underset{\displaystyle R_{14}}{|}}{C}{-}CH_2{-}X{-}\overset{\overset{\displaystyle O}{\|}}{C}{-}CH_2{-}W \qquad (11)$$

wherein W is —CN or —$COCH_3$, X is O, NH or S, and $R_{14}$ is a hydrogen atom or methyl group.

The allyl or methallyl cyano acetates of formula (11) may be prepared by reacting allyl or methallyl alcohol with cyanoacetic acid.

The allyl or methallyl cyanoacetamides may be prepared as described in U.S. Pat. No. 2,808,331.

Allyl or methallyl acetoacetate may be prepared by the noncatalytic ester exchange reaction of beta-keto carboxylic acid esters as described in U.S. Pat. No. 2,693,484.

The allyl or methallyl acetoacetamides may be prepared by the reaction of diketene with allyl or methallyl amine.

The allyl or methallyl acetothioacetates may be prepared by reacting allyl or methallyl mercaptan with diketene.

The allyl or methallyl cyano thioacetates may be prepared by the reaction of allyl or methallyl mercaptan with cyanoacetyl chloride.

The preferred monomers of formula (11) for use in the copolymer of the use in the present invention are those wherein $R_{14}$ is hydrogen and X is O. The most preferred monomers are allyl cyanoacetate and allyl acetoacetate.

The combination of surfactants used in the process of the present invention produce a very stable latex layer which contains substantially no unreacted monomers and no gummy undispersed product. In fact it is particularly difficult to prepare a stable completely dispersed latex when the monomer mixture comprises a high proportion of vinylidene chloride as does the preferred monomers mixture in this invention. However the combination of surfactants used in the process of this invention enables very stable dispersed latex to be prepared even though there may be at least 80% vinylidene chloride in the monomer mixture employed.

After a latex has been prepared and before it is coated on to a receptive polyester film there is often added to the latex further surfactant to enable the latex to spread evenly on the polyester, when it is coated thereon. Usually it is preferred to add further amounts of the surfactant or surfactant mixture used to prepare the latex initially to ensure that the latex does not flocculate. The surfactant combination of use in the present invention is a particularly efficacious spreading agent and thus when a further amount of the surfactants e.g. 0.03% by volume of the coating mixture is added to the latex this enables the latex to be coated very evenly on the polyester film.

However when other nonionic surfactants or other anionic surfactants are used in place of those of the present invention very often greater quantities are required to give even spreading, and the adhesion of the subbing layer is impaired.

Furthermore when the copolymer layer is present as a coated layer on the polyester film base it exhibits a relatively high surface conductivity. This means that the film base does not always require to be treated with any other antistatic agent when it is coated with a light-sensitive layer. Thus a production step can be cut out.

The film base material prepared by the process of the present invention is able to accept a hydrophilic layer adherent thereto, for example a gelatin based layer, a polyvinyl alcohol layer or polyvinyl acetal layer.

The gelatin based layer may be a gelatino silver halide emulsion layer but sometimes when the process of the present invention is employed to prepare film base material for use in the production of photographic gelatin silver halide material an intermediate gelatin layer is provided between the copolymer layer as hereinbefore defined and the silver halide emulsion layer.

However if the copolymer used comprises an allyl, methallyl or vinyl monomer which contains an active methylene group and/or an active halogen group it is possible to coat directly on to the copolymer layer a gelatino silver halide emulsion layer. The gelatino silver halide emulsion layer adheres very strongly to the copolymer subbing layer on the film base and neither the gelatin layer nor the subbing layer fall away from the polyester film during either prolonged aqueous processing or water washing.

The particular advantages of eliminating antistatic and gelatin subbing layers are the reduction in the number of operations thus minimising potential defects, as well as, in the case of interdraw coating, the possibility of all of the coatings being carried out in one continuous operation on one machine.

Therefore according to a preferred method of the present invention there is provided a process for the preparation of silver halide photographic material which comprises preparing an uniaxially oriented film of polyester, coating as a layer on this film an aqueous latex of a copolymer which comprises from 60 to 90 mole % vinylidene chloride, from 7 to 20 mole % alkyl acrylate or methacrylate, from 0 to 3 mole % copolymerisable acid and from 5 to 20 mole % of a component derived from either an allyl or a vinyl monomer which comprises an active methylene group and/or an active halogen group the copolymerisation taking place in the presence of a mixture of an anionic surfactant which is either an alkyl aryl polyether sulphate or sulphonate of formula (1) or an alkyl aryl phosphate of formula (2) together with a nonionic surfactant containing at least some hydroxypropylene oxide derived units of general formula (3) or of the general formula (4), the proportions of nonionic to anionic surfactant being from 5 to 50 by weight up to 20 to 50 by weight, the total amount of surfactant present in the aqueous medium being up to 2% w/v of the monomers used, then drying the coated layer and completing the orientation and then coating on to the dried copolymer layer a gelatino silver halide layer and drying the silver halide emulsion layer.

When the hydrophilic layer to be applied to the film base material as prepared by the process of the present invention is polyvinyl alcohol or polyvinyl acetal such a hydrophilic layer may comprise a light-sensitive diazonium salt to produce a diazotype material.

Alternatively after a polyvinyl alcohol or polyvinyl acetal layer has been coated on to the film base material as prepared by the process of the present invention the polyvinyl alcohol or polyvinyl acetal may have incorporated therein or be coated with a light-sensitive diazonium salt to produce a diazotype material.

It is to be understood that the process of the present invention covers not only the process of preparing subbed biaxially oriented linear polyester film base but the polyester film base when so prepared as well as photographic material having coated on the film base at least one light-sensitive layer.

The following Examples will serve to illustrate the invention.

In these examples surfactant A is of the formula

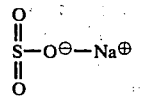

Surfactant B is of the formula

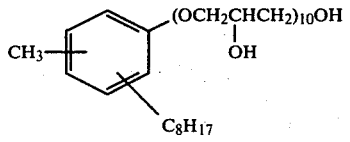

(13)

Surfactant C is of the formula

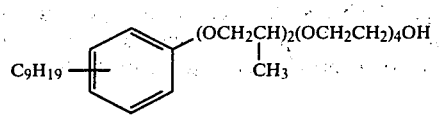

(14)

Surfactant D is of the formula

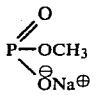

EXAMPLE 1

The following two solutions were prepared:

| | | |
|---|---|---|
| (a) | vinylidene chloride | 1050 ml |
| | methyl acrylate | 132 ml |
| (b) | water | 2,600 |
| | itaconic acid | 30 g |
| | surfactant A | 20 g |
| | surfactant B | 2.6 g |
| | sodium persulphate | 10 g |
| | sodium metabisulphite | 10 g |

Solutions (a) and (b) are simultaneously pumped into a stirred 5 liter reactor under nitrogen, kept at 30° C., over a period of 3 hours. The resulting latex was decanted and coated on biaxially oriented polyester base, pretreated with an aqueous solution of a phenolic adhesion promoting agent and the layer dried. A gelatin sub solution was coated over the copolymer layer followed by a gelatino silver halide emulsion.

This photographic material exhibited no frilling of any of the layers when soaked in an alkaline photographic developer for 10 minutes followed by an acid fix solution and water washing over ½ hour.

EXAMPLE 2

The following two solutions were prepared and used to make a latex as in Example 1.

| | | |
|---|---|---|
| Solution (a) | vinylidene chloride | 1050 ml |
| | methyl acrylate | 132 ml |
| | allyl aceto acetate | 132 ml |
| Solution (b) | water | 2,600 ml |
| | surfactant A | 20 g |
| | surfactant C | 3 g |
| | sodium persulphate | 10 g |
| | sodium metabisulphite | 10 g |

The resulting latex was coated onto uniaxially oriented polyester prepared by extruding onto a chilled drum, heated to between 80° and 100° C. and stretched over capstan rollers of increasing circumferential speed to a draw ratio of about 3. The copolymer layer was dried at about 90° C. and the polyester was stretched laterally in a stenter apparatus at between 180° to 200° C. to a draw ratio of about 3.

The biaxially oriented polyester was heat set at about 200° C. while the tension was maintained for 1 to 4 minutes. The surface resistivity of the base was $10^9$ ohms/square at 65% RH thus eliminating the need for a further antistatic layer.

The base was directly coated with a gelatino silver halide emulsion and after ageing the layers showed excellent adhesion when treated as in Example 1.

EXAMPLE 3

The following two solutions were prepared and used to make a latex as in Example 1.

| | | |
|---|---|---|
| Solution (a) | vinylidene chloride | 1050 ml |
| | methyl acrylate | 132 ml |
| | allyl monochloroacetate | 132 ml |
| solution (b) | water | 2,600 ml |
| | surfactant D | 12.5 g |
| | surfactant B | 2.7 g |
| | itaconic acid | 30 g |
| | sodium persulphate | 10 g |
| | sodium metabisulphite | 10 g |

The resulting latex was coated onto biaxially oriented polyester which had been treated by corona discharge, and a gelatine sub solution and a gelatino silver halide emulsion were then coated over it. The adhesion of the layers was excellent when treated as in Example 1.

Example 4

The following two solutions were prepared and used to make a latex.

| | | |
|---|---|---|
| Solution (a) | vinylidene chloride | 1050 ml |
| | methyl acrylate | 132 ml |
| | vinyl monochloroacetate | 132 ml |
| Solution (b) | water | 2,600 |
| | surfactant A | 12.5 g |
| | surfactant B | 3.0 g |
| | itaconic acid | 30 g |
| | sodium persulphate | 10 g |
| | sodium metabisulphite | 10 g |

The resulting latex was coated or to biaxially oriented polyester base which had been pretreated with an aqueous solution of a phenolic adhesion promoting agent and subsequently dried. A gelatin sub was coated on the layer following by a gelatino silver halide emulsion. The layers showed excellent adhesion when treated as in Example 1.

A similar series of latexes was prepared using the surfactant A only but in each case a poor latex resulted, of low yield leaving large quantities of gummy residues in the vessel.

Similar latexes to those of Example 2 and 3 were made using sodium alkane ($C_8$–$C_{14}$) sulphate and alkylated ($C_8$–$C_{14}$) sodium sulpho succinate. In both cases poor latexes, with incomplete polymerisation and gummy residues resulted.

A latex similar to Example 1 was made using sodium lauryl sulphate alone. This gave a good latex but a dried coated layer of this latex showed a poor surface resistivity of $10^{12}$ ohms/square at 65% RH and poor adhesion.

What we claim is:

1. A process for the preparation of silver halide photographic material which comprises preparing an uniaxially oriented film of synthetic linear polyester of highly hydrophobic character, coating as a layer on this film an aqueous latex of a copolymer which comprises from 60 to 90 mole % vinylidene chloride, from 7 to 20 mole % alkyl acrylate or methacrylate, from 0 to 3 mole % copolymerisable acid and from 5 to 20 mole % of an allyl, methallyl or vinyl monomer which comprises an active halogen group an active methylene group the copolymerisation taking place in the presence of a mixture of an anionic surfactant which is either an alkyl aryl polyester sulphate or sulphonate of the formula

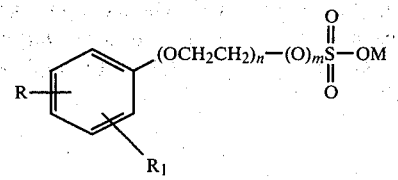

or an alkyl aryl polyether phosphate of the formula

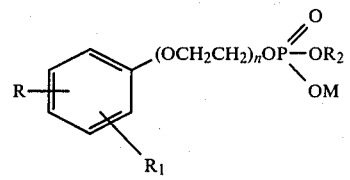

wherein R is alkyl of 6 to 10 carbon atoms, $R_1$ is hydrogen or alkyl of 1 to 5 carbon atoms, M is hydrogen, an alkali metal or ammonium, $R_2$ is hydrogen, an alkali metal, ammonium or alkyl of 1 to 5 carbon atoms, m is 0 or 1 and n is 3 to 15, and a nonionic surfactant which is an alkyl aryl polyalkylene oxide containing at least some polypropylene oxide derived units of the formula

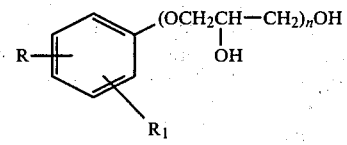

or of the formula

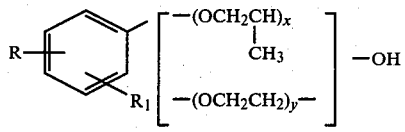

where R is alkyl of 6 to 10 carbon atoms, $R_1$ is hydrogen or alkyl of 1 to 5 carbon atoms, n is 3 to 15, x is 1 to 4 and y is 3 to 10, the proportions of nonionic to anionic surfactant being from 5 to 50 by weight up to 20 to 50 by weight, the total amount of surfactant present in the aqueous medium being up to 2% W/V of the monomers used, then drying the coated layer and completing the orientation to obtain a biaxially oriented polyester film and then coating on to the dried copolymer layer a gelatino silver halide emulsion layer and drying the silver halide emulsion layer.

2. Light-sensitive photographic film element which comprises a light-sensitive silver halide layer coated either directly or on an interlayer which is coated directly on a film base material consisting of biaxially oriented synthetic linear polyester of highly hydrophobic character wherein said film element is produced by a method which comprises coating as a layer on to a layer-receptive film of linear polyester an aqueous latex of a copolymer which has been prepared by copolymerizing vinylidene chloride, an alkyl acrylate or methacrylate and optionally a copolymerizable acid and/or at least one allyl, methallyl or vinyl monomer which comprises either an active halogen group or an active methylene group, the improvement which comprises adding to said latex, a mixture of an anionic surfactant which is either an alkyl aryl polyether sulfate or sulphonate of the formula

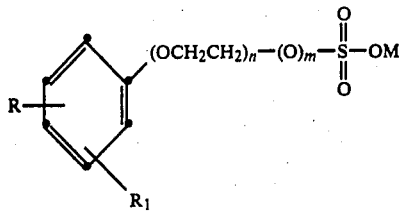

or an alkyl aryl polyether phosphate of the formula

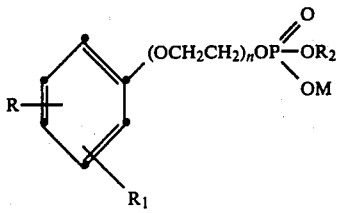

wherein

R is alkyl having 6 to 10 carbon atoms, $R_1$ is hydrogen or alkyl having 1 to 5 carbon atoms, M is hydrogen, an alkali metal or ammonium, $R_2$ is hydrogen, an alkali metal, ammonium or alkyl having 1 to 5 carbon atoms, m is 0 or 1 and n is 3 to 15, and a nonionic surfactant which is an alkyl aryl polyalkylene oxide containing at least some hydroxypropylene oxide derived units of the formula

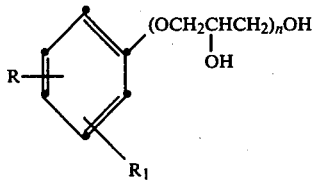

or of the formula

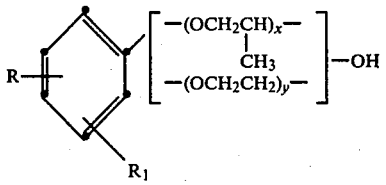

wherein

R, $R_1$ and n have the meanings assigned to them above, x is 1 to 4, and y is 3 to 10, the proportions of nonionic to anionic surfactant being from 1 to 50 by weight up to 50 to 50 by weight, the total amount of surfactant present in the aqueous medium being up to 3% W/V of the monomers used, and then drying the coated layer and completing the orientation if it has not already been biaxially oriented, and coating on to the dried copolymer layer a gelatino silver halide emulsion layer and drying said silver halide emulsion layer.

3. A light sensitive photographic film material of claim 2, wherein in preparing the film base material the anionic surfactant used is the alkyl aryl polyether sulphate of the formula

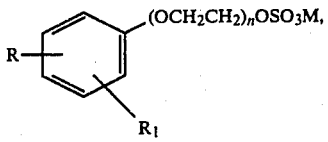

wherein R, $R_1$, n and M have the meanings indicated in claim 2.

4. A light sensitive photographic film material according to claim 2 wherein $R_1$ is hydrogen, M is alkali metal and n is 8 to 10.

5. A light sensitive photographic film material according to claim 2 wherein the non-ionic surfactant used is the alkyl aryl hydroxypropylene oxide derivative of formula

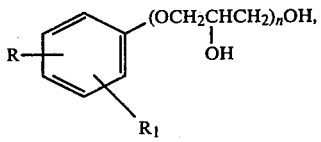

wherein R, $R_1$ and n have the meanings indicated in claim 2.

6. A light sensitive photographic film material of claim 2, wherein $R_1$ is alkyl of 1 to 5 carbon atoms and n is 6 to 10.

7. A light sensitive photographic film material according to claim 2 wherein the ratio of non-ionic surfactant to anionic surfactant is from 3 to 50 to 20 to 50 parts by weight.

8. A light sensitive photographic film material according to claim 2 wherein the copolymer formed comprises from 60 to 90 mol % vinylidene chloride, from 7 to 20 mol % alkyl acrylateor methacrylate, from 0 to 3 mol % copolymerizable acid and from 5 to 20 mol % of the allyl or vinyl component.

* * * * *